US008294650B2

(12) United States Patent
Shiomi et al.

(10) Patent No.: US 8,294,650 B2
(45) Date of Patent: Oct. 23, 2012

(54) DISPLAY PANEL DRIVING APPARATUS, DISPLAY APPARATUS, DISPLAY PANEL DRIVING METHOD, AND TELEVISION RECEIVER

(75) Inventors: Makoto Shiomi, Tenri (JP); Toshihisa Uchida, Suzuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 884 days.

(21) Appl. No.: 12/224,828

(22) PCT Filed: Dec. 19, 2006

(86) PCT No.: PCT/JP2006/325264

§ 371 (c)(1),
(2), (4) Date: Sep. 8, 2008

(87) PCT Pub. No.: WO2007/122776

PCT Pub. Date: Nov. 1, 2007

(65) Prior Publication Data

US 2009/0021463 A1 Jan. 22, 2009

(30) Foreign Application Priority Data

Apr. 14, 2006 (JP) ..... 2006-112780

(51) Int. Cl.
*G09G 3/36* (2006.01)

(52) U.S. Cl. ..... 345/89; 345/204; 345/690

(58) Field of Classification Search ..... 345/87–104, 345/204–207, 690–699; 348/42, 51, 55
See application file for complete search history.

(56) References Cited

U.S. PATENT DOCUMENTS 7,391,391 B2 * 6/2008 Ohshima ..... 345/60
2001/0038369 A1 11/2001 Adachi et al.
2002/0044115 A1 4/2002 Jinda et al.
(Continued)

FOREIGN PATENT DOCUMENTS

CN 1571008 1/2005
(Continued)

OTHER PUBLICATIONS

U.S. Office Action dated Jun. 29, 2011.
(Continued)

*Primary Examiner* — Alexander Eisen
*Assistant Examiner* — Sanjiv D Patel
(74) *Attorney, Agent, or Firm* — Harness, Dickey & Pierce, P.L.C.

(57) ABSTRACT

In one embodiment, a display panel driving apparatus which generates, based on an input gray scale, a gray scale of a first sub-frame and a gray scale of a second sub-frame so as to display the input gray scale as a result of a summation of respective display corresponding to the first sub-frame and the second sub-frame into which one frame is divided, and the gray scale of the second sub-frame being greater than the gray scale of the first sub-frame, for a response in which the input gray scale of a subsequent frame is greater than an input gray scale of a previous frame and the input gray scale of the subsequent frame is not less than a first threshold gray scale, a gray scale of the first sub-frame in the subsequent frame is set not more than a second threshold gray scale, regardless of input gray scale of the subsequent frame. Thus, it is possible to reduce jaggy in an edge of a moving image in time-division driving.

22 Claims, 8 Drawing Sheets

U.S. PATENT DOCUMENTS

| | | | | |
|---|---|---|---|---|
| 2003/0048247 | A1 | 3/2003 | Ham | |
| 2003/0156092 | A1 | 8/2003 | Suzuki et al. | |
| 2004/0017343 | A1 | 1/2004 | Adachi et al. | |
| 2004/0196229 | A1* | 10/2004 | Ham | 345/87 |
| 2004/0196274 | A1 | 10/2004 | Song et al. | |
| 2005/0140626 | A1 | 6/2005 | Doyen et al. | |
| 2005/0162360 | A1* | 7/2005 | Ishihara et al. | 345/89 |
| 2005/0200619 | A1* | 9/2005 | Adachi et al. | 345/204 |
| 2006/0022922 | A1 | 2/2006 | Jinda et al. | |
| 2006/0038837 | A1* | 2/2006 | Hong | 345/691 |
| 2006/0125748 | A1* | 6/2006 | Yang et al. | 345/88 |
| 2006/0256141 | A1 | 11/2006 | Maruyama et al. | |
| 2007/0018934 | A1 | 1/2007 | Kim et al. | |
| 2008/0211755 | A1 | 9/2008 | Song et al. | |
| 2009/0121994 | A1* | 5/2009 | Miyata | 345/89 |
| 2010/0164996 | A1 | 7/2010 | Tomizawa et al. | |

FOREIGN PATENT DOCUMENTS

| | | |
|---|---|---|
| JP | 2001-343956 | 12/2001 |
| JP | 2002-116743 | 4/2002 |
| JP | 2003-84742 | 3/2003 |
| JP | 2003-241721 | 8/2003 |
| JP | 2004-264725 | 9/2004 |
| JP | 2004-310113 | 11/2004 |
| JP | 2005-003897 | 1/2005 |
| JP | 2005-43875 | 2/2005 |
| JP | 2007-078860 | 3/2007 |

OTHER PUBLICATIONS

US Office Action mailed Dec. 2, 2011 for corresponding U.S. Appl. No. 12/224,856.

Notice of Allowance dated Mar. 12, 2012 for corresponding U.S. Appl. No. 12/224,856.

* cited by examiner

FIG. 2

| DEFn(SUB-FRAME CALCULATION GRAY SCALE) | | | | | | | | | | |
|---|---|---|---|---|---|---|---|---|---|---|
| | | DFn | | | | | | | | |
| | | 0 | 32 | 64 | 96 | 128 | 160 | 192 | 224 | 255 |
| DF(n-1) | 0 | 0 | 41 | 78 | 107 | 143 | 152 | 152 | 152 | 152 |
| | 32 | 0 | 32 | 67 | 98 | 134 | 152 | 152 | 152 | 152 |
| | 64 | 0 | 28 | 64 | 97 | 133 | 152 | 152 | 152 | 152 |
| | 96 | 0 | 26 | 63 | 96 | 131 | 152 | 152 | 152 | 152 |
| | 128 | 0 | 25 | 62 | 96 | 128 | 152 | 152 | 152 | 152 |
| | 160 | 0 | 25 | 62 | 95 | 126 | 160 | 152 | 152 | 152 |
| | 192 | 0 | 25 | 61 | 95 | 126 | 159 | 192 | 152 | 152 |
| | 224 | 0 | 24 | 61 | 95 | 126 | 159 | 191 | 224 | 152 |
| | 255 | 0 | 24 | 60 | 95 | 125 | 159 | 189 | 224 | 255 |

FIG. 3

| DEF n | DSF n1 | DSF n2 |
|---|---|---|
| 0 | 0 | 0 |
| 1 | 0 | 16 |
| 2 | 0 | 23 |
| 3 | 0 | 28 |
| 4 | 0 | 33 |
| 5 | 1 | 37 |
| 6 | 1 | 41 |
| 7 | 1 | 45 |
| 8 | 1 | 48 |
| 9 | 1 | 52 |
| 10 | 2 | 55 |
| 11 | 2 | 58 |
| 12 | 2 | 61 |
| 13 | 2 | 63 |
| 14 | 2 | 66 |
| 15 | 2 | 69 |
| 16 | 2 | 71 |
| 17 | 2 | 74 |
| 18 | 2 | 76 |
| 19 | 2 | 79 |
| 20 | 2 | 81 |
| 21 | 2 | 83 |
| 22 | 2 | 86 |
| 23 | 3 | 88 |
| 24 | 3 | 90 |
| 25 | 3 | 92 |
| 26 | 3 | 94 |
| 27 | 3 | 97 |
| 28 | 3 | 99 |
| 29 | 3 | 101 |
| 30 | 3 | 103 |
| 31 | 3 | 105 |
| 32 | 3 | 107 |
| 33 | 3 | 109 |
| 34 | 3 | 111 |
| 35 | 3 | 112 |
| 36 | 3 | 114 |
| 37 | 3 | 116 |
| 38 | 3 | 118 |
| 39 | 3 | 120 |
| 40 | 3 | 122 |
| 41 | 3 | 123 |
| 42 | 3 | 125 |
| 43 | 3 | 127 |
| 44 | 3 | 129 |
| 45 | 3 | 130 |
| 46 | 3 | 132 |
| 47 | 3 | 134 |
| 48 | 3 | 135 |
| 49 | 3 | 137 |
| 50 | 3 | 138 |

| DEF n | DSF n1 | DSF n2 |
|---|---|---|
| 51 | 3 | 140 |
| 52 | 3 | 142 |
| 53 | 3 | 143 |
| 54 | 3 | 145 |
| 55 | 4 | 146 |
| 56 | 4 | 148 |
| 57 | 4 | 149 |
| 58 | 4 | 151 |
| 59 | 4 | 152 |
| 60 | 4 | 154 |
| 61 | 4 | 155 |
| 62 | 4 | 157 |
| 63 | 4 | 158 |
| 64 | 4 | 159 |
| 65 | 4 | 161 |
| 66 | 4 | 162 |
| 67 | 4 | 164 |
| 68 | 4 | 165 |
| 69 | 4 | 166 |
| 70 | 4 | 168 |
| 71 | 4 | 169 |
| 72 | 4 | 170 |
| 73 | 4 | 171 |
| 74 | 4 | 173 |
| 75 | 4 | 174 |
| 76 | 4 | 175 |
| 77 | 4 | 176 |
| 78 | 4 | 178 |
| 79 | 5 | 179 |
| 80 | 5 | 180 |
| 81 | 5 | 181 |
| 82 | 5 | 182 |
| 83 | 5 | 184 |
| 84 | 5 | 185 |
| 85 | 5 | 186 |
| 86 | 5 | 187 |
| 87 | 5 | 188 |
| 88 | 5 | 189 |
| 89 | 5 | 190 |
| 90 | 5 | 191 |
| 91 | 5 | 193 |
| 92 | 5 | 194 |
| 93 | 5 | 195 |
| 94 | 6 | 196 |
| 95 | 6 | 197 |
| 96 | 6 | 198 |
| 97 | 6 | 199 |
| 98 | 6 | 200 |
| 99 | 6 | 201 |
| 100 | 6 | 202 |

| DEF n | DSF n1 | DSF n2 |
|---|---|---|
| 101 | 6 | 203 |
| 102 | 6 | 204 |
| 103 | 6 | 205 |
| 104 | 6 | 206 |
| 105 | 7 | 207 |
| 106 | 7 | 207 |
| 107 | 7 | 208 |
| 108 | 7 | 209 |
| 109 | 7 | 210 |
| 110 | 7 | 211 |
| 111 | 7 | 212 |
| 112 | 7 | 213 |
| 113 | 7 | 214 |
| 114 | 8 | 214 |
| 115 | 8 | 215 |
| 116 | 8 | 216 |
| 117 | 8 | 217 |
| 118 | 8 | 218 |
| 119 | 8 | 218 |
| 120 | 8 | 219 |
| 121 | 9 | 220 |
| 122 | 9 | 221 |
| 123 | 9 | 222 |
| 124 | 9 | 222 |
| 125 | 9 | 223 |
| 126 | 9 | 224 |
| 127 | 10 | 224 |
| 128 | 10 | 225 |
| 129 | 10 | 226 |
| 130 | 10 | 227 |
| 131 | 10 | 227 |
| 132 | 10 | 228 |
| 133 | 11 | 229 |
| 134 | 11 | 229 |
| 135 | 11 | 230 |
| 136 | 11 | 230 |
| 137 | 12 | 231 |
| 138 | 12 | 232 |
| 139 | 12 | 232 |
| 140 | 12 | 233 |
| 141 | 13 | 234 |
| 142 | 13 | 234 |
| 143 | 13 | 235 |
| 144 | 13 | 235 |
| 145 | 14 | 236 |
| 146 | 14 | 236 |
| 147 | 14 | 237 |
| 148 | 15 | 237 |
| 149 | 15 | 238 |
| 150 | 15 | 238 |

| DEF n | DSF n1 | DSF n2 |
|---|---|---|
| 151 | 15 | 239 |
| 152 | 16 | 239 |
| 153 | 16 | 240 |
| 154 | 17 | 240 |
| 155 | 17 | 241 |
| 156 | 17 | 241 |
| 157 | 18 | 242 |
| 158 | 18 | 242 |
| 159 | 18 | 243 |
| 160 | 19 | 243 |
| 161 | 20 | 243 |
| 162 | 21 | 243 |
| 163 | 21 | 244 |
| 164 | 22 | 244 |
| 165 | 23 | 244 |
| 166 | 24 | 244 |
| 167 | 25 | 244 |
| 168 | 26 | 245 |
| 169 | 27 | 245 |
| 170 | 28 | 245 |
| 171 | 29 | 245 |
| 172 | 30 | 245 |
| 173 | 31 | 245 |
| 174 | 32 | 246 |
| 175 | 33 | 246 |
| 176 | 34 | 246 |
| 177 | 35 | 246 |
| 178 | 36 | 246 |
| 179 | 37 | 247 |
| 180 | 39 | 247 |
| 181 | 40 | 247 |
| 182 | 41 | 247 |
| 183 | 42 | 247 |
| 184 | 44 | 247 |
| 185 | 45 | 248 |
| 186 | 47 | 248 |
| 187 | 48 | 248 |
| 188 | 49 | 248 |
| 189 | 51 | 248 |
| 190 | 53 | 248 |
| 191 | 54 | 248 |
| 192 | 56 | 249 |
| 193 | 57 | 249 |
| 194 | 59 | 249 |
| 195 | 61 | 249 |
| 196 | 63 | 249 |
| 197 | 64 | 249 |
| 198 | 66 | 249 |
| 199 | 68 | 250 |
| 200 | 70 | 250 |

| DEF n | DSF n1 | DSF n2 |
|---|---|---|
| 201 | 72 | 250 |
| 202 | 74 | 250 |
| 203 | 76 | 250 |
| 204 | 78 | 250 |
| 205 | 80 | 250 |
| 206 | 83 | 250 |
| 207 | 85 | 251 |
| 208 | 87 | 251 |
| 209 | 89 | 251 |
| 210 | 92 | 251 |
| 211 | 94 | 251 |
| 212 | 97 | 251 |
| 213 | 99 | 251 |
| 214 | 102 | 251 |
| 215 | 104 | 251 |
| 216 | 107 | 252 |
| 217 | 110 | 252 |
| 218 | 113 | 252 |
| 219 | 115 | 252 |
| 220 | 118 | 252 |
| 221 | 121 | 252 |
| 222 | 124 | 252 |
| 223 | 127 | 252 |
| 224 | 130 | 252 |
| 225 | 133 | 252 |
| 226 | 136 | 253 |
| 227 | 140 | 253 |
| 228 | 143 | 253 |
| 229 | 146 | 253 |
| 230 | 150 | 253 |
| 231 | 153 | 253 |
| 232 | 157 | 253 |
| 233 | 160 | 253 |
| 234 | 164 | 253 |
| 235 | 168 | 253 |
| 236 | 171 | 253 |
| 237 | 175 | 253 |
| 238 | 179 | 253 |
| 239 | 183 | 254 |
| 240 | 187 | 254 |
| 241 | 191 | 254 |
| 242 | 195 | 254 |
| 243 | 199 | 254 |
| 244 | 204 | 254 |
| 245 | 208 | 254 |
| 246 | 212 | 254 |
| 247 | 217 | 254 |
| 248 | 221 | 254 |
| 249 | 226 | 254 |
| 250 | 230 | 254 |
| 251 | 235 | 254 |
| 252 | 240 | 254 |
| 253 | 245 | 254 |
| 254 | 250 | 254 |
| 255 | 255 | 255 |

DISPLAY PANEL DRIVING APPARATUS, DISPLAY APPARATUS, DISPLAY PANEL DRIVING METHOD, AND TELEVISION RECEIVER

TECHNICAL FIELD

The present invention relates to a time-division driving in which one frame is divided into a plurality of sub-frames.

BACKGROUND ART

Proposals have been made for a time-division driving in which one frame is divided into a plurality of sub-frames (for example, a first sub-frame and a second sub-frame) and an input gray scale is displayed as a result of a summation of respective display of the sub-frames (for example, see Patent Document 1).

FIG. 7 is a graph for determining a gray scale of the first sub-frame and a gray scale of the second sub-frame, for each input gray scale. According to the graph shown in FIG. 7, the gray scale of the first sub-frame is set not more than the gray scale of the second sub-frame for each of the input gray scales. This allows the first sub-frame to be a dark sub-frame (a sub-frame having low brightness) and the second sub-frame to be a bright sub-frame (a sub-frame having high brightness). For example, when an input gray scale is 192 gray scale, the first and second sub-frames are set to have 56 gray scale and 249 gray scale, respectively. When an input gray scale is 64 gray scale, the first and second sub-frames are set to have 4 gray scale and 159 gray scale, respectively. As a result of a summation of respective display of the sub-frames, an input gray scale (192 gray scale or 64 gray scale) is displayed.

FIG. 8 illustrates one example of a moving image displayed based on such a time-division driving. FIG. 8 illustrates an image P moving to the right in a black background. In the image P, an area X which has 192 gray scale and an area Y which has 64 gray scale are adjacent to each other, i.e., a high gray scale area X and a low gray scale area Y are adjacent to each other so that their respective adjacent edges form a line.

In this moving image display, the first and second sub-frames are set to have 56 gray scale and 249 gray scale, respectively, in the area X. In the area Y, the first and second sub-frames are set to have 4 gray scale and 159 gray scale, respectively. sFa through sFf shown in FIG. 9 schematically illustrates display for each sub-frame in this moving image display.

More specifically, a right edge of each of the areas (X, Y) in the image P is of a rising response from 0 gray scale. The first sub-frame of the area X has a visible 56 gray scale, whereas the first sub-frame of the area Y has an invisible 4 gray scale. The second sub-frame of the area X has a visible 249 gray scale, and the second sub-frame of the area Y has also a visible 159 gray scale.

[Patent Document 1]

Japanese Unexamined Patent Publication, Tokukai, No. 2005-173573 (published Jun. 30, 2005)

DISCLOSURE OF INVENTION

Therefore, as illustrated in FIG. 9, although the right edge of the area X in each frame starts to be visualized from the first sub-frame (sFa, sFc, sFe) (see solid line arrow), the right edge of the area Y in each frame starts to be visualized only from the second sub-frame (sFb, sFd, sFf) (see dotted line arrow).

Specifically, the right edges of the areas X and Y, which essentially should start to be simultaneously visualized in each frame, are actually started to be visualized with a delay of half a frame from each other (the right edge of the area Y is delayed). When the right edges of the areas X and Y are not started to be simultaneously visualized in this manner, a temporal integration value (integration value in terms of time) of the right edge in the area X deviates from that in the area Y. This causes a problem that jaggy appears as shown in FIG. 12, although the image P essentially should be visualized as shown in FIG. 11.

The present invention is made in view of the above problem, and its object is to provide a display panel driving apparatus capable of improving the quality of a moving image display on a display panel.

A display panel driving apparatus in accordance with the present invention is a display panel driving apparatus which generates, based on an input gray scale, a gray scale of a first sub-frame and a gray scale of a second sub-frame so as to display the input gray scale as a result of a summation of respective display corresponding to the first sub-frame and the second sub-frame into which one frame is divided, and the gray scale of the second sub-frame being not less than the gray scale of the first sub-frame, for a response in which (i) an input gray scale of a subsequent frame is greater than an input gray scale of a previous frame and (ii) the input gray scale of the subsequent frame is not less than a first threshold gray scale, a gray scale of the first sub-frame in the subsequent frame is set not more than a second threshold gray scale, regardless of input gray scale of the subsequent frame.

With the arrangement, it is possible that an edge (an edge in a moving direction) of a high gray scale area is hardly visualized in the first sub-frame, in a moving image display in which, for example, an image moves in a low gray scale background, the image including a high gray scale area and a low gray scale area which are adjacent to each other and which respective adjacent edges form a line. This causes the edges of the high gray scale area and the low gray scale area to start being visualized at the same timing, thereby matching temporal integration values of brightness in the respective edges. Consequently, it is possible to remarkably reduce jaggy at an edge of a moving image, which jaggy has been conventionally recognized in such display. Therefore, it is possible to improve the quality of a moving image display on a display panel.

In the display panel driving apparatus of the present invention, a gray scale TH and a gray scale TL satisfy (i) the first threshold gray scale<the gray scale TH and (ii) the gray scale TL<the gray scale TH; in a response in which input gray scales of the previous and subsequent frames are both the gray scale TH, a gray scale TH1 is outputted as the gray scale of the first sub-frame in the subsequent frame; in a response in which input gray scales of the previous and subsequent frames are TL and TH, respectively, a gray scale Th1 is outputted as the gray scale of the first sub-frame in the subsequent frame; and the gray scales TH1 and Th1 satisfy (i) Th1≦the second threshold gray scale and (ii) TH1≧Th1.

In the display panel driving apparatus of the present invention, it is preferable for the first threshold gray scale to be greater than a medium gray scale of all of input gray scales. It is also preferable for the second threshold gray scale to be not more than 32 gray scale out of 256 gray scales. In such a case, the second threshold gray scale is more preferably 16 gray scale out of the 256 gray scales.

In the display panel driving apparatus of the present invention, in the response as the aforementioned (response in which (i) the input gray scale of the subsequent frame is greater than an input gray scale of the previous frame and (ii) the input gray scale of the subsequent frame is not less than a first threshold gray scale), it is preferable for a difference between brightness corresponding to the gray scale of the first sub-frame in the subsequent frame and brightness corresponding to the gray scale of the first sub-frame in the previous frame to be not more than 15 percent of the brightness in accordance with the gray scale of the first sub-frame in the previous frame. It is more preferable to be not more than 5 percent. This allows a reduction in gray scale transition amount in the first sub-frame (of the previous and subsequent frames) in the above rising response. This allows the first sub-frame in the subsequent frame not to be independently visualized (to be difficult to visualize).

The display panel driving apparatus may be arranged such that a sub-frame calculation gray scale is generated by using the input gray scale of the previous frame and the input gray scale of the subsequent frame, and the gray scales of the first and second sub-frames in the subsequent frame are generated by using the sub-frame calculation gray scale. In such case, it is preferable for the sub-frame calculation gray scale to be attained by carrying out a gray scale transition enhancement process with respect to the input gray scale in the subsequent frame. When a difference between the input gray scales of the previous and subsequent frames is 0 or is less than a predetermined value, it is preferable such that the input gray scale of the subsequent frame is generated as the sub-frame calculation gray scale.

The display panel driving apparatus of the present invention includes a first table which corresponds a combination of the input gray scales of the previous and subsequent frames to the sub-frame calculation gray scale, and the sub-frame calculation gray scale may be generated based on the first table. The display panel driving apparatus of the present invention includes a second table which corresponds the sub-frame calculation gray scale to the first sub-frame in the subsequent frame, and the gray scale of the first sub-frame in the subsequent frame may be generated based on the second table. The display panel driving apparatus includes a third table which corresponds the sub-frame calculation gray scale to the second sub-frame in the subsequent frame, and the gray scale of the second sub-frame in the subsequent frame may be generated based on the third table.

In the arrangement, in the first table, a single predetermined gray scale is set for all combinations in which (i) the input gray scale of the subsequent frame is greater than the input gray scale of the previous frame and (ii) the input gray scale of the subsequent frame is not less than the first threshold gray scale; and the predetermined gray scale may be generated as the sub-frame calculation gray scale for all combinations in which input gray scales of the previous and subsequent frames fall within the combinations. Furthermore, in the second table, the predetermined gray scale is corresponded to the second threshold gray scale; and when the sub-frame calculation gray scale is the predetermined gray scale, the display panel driving apparatus may be arranged so that the second threshold gray scale is generated as the first sub-frame in the subsequent frame.

The display panel driving apparatus of the present invention preferably drives a liquid crystal panel. In such case, the liquid crystal panel may be of a normally black type. The liquid crystal panel also may include an n-type vertical alignment liquid crystal.

The display panel driving apparatus of the present invention is a display panel driving apparatus which generates, based on the input gray scale, gray scales of first through n-th sub-frames so as to display the input gray scale as a result of a summation of respective display corresponding to the first through n-th sub-frames into which one frame is divided, the first through n-th sub-frames being divided into a first half section including at least the first sub-frame and a last half section including at least the n-th sub-frame, and each sub-frames of the last half section has a gray scale greater than that of each sub-frame of the first half section, for a response in which (i) an input gray scale of a subsequent frame is greater than an input gray scale of a previous frame and (ii) the input gray scale of the subsequent frame is not less than a first threshold gray scale, the gray scale of the each sub-frame of the first half section in the subsequent frame is set not more than a second threshold gray scale, regardless of input gray scale of the subsequent frame.

A method of the present invention for driving a display panel, which method generates, based on an input gray scale, a gray scale of a first sub-frame and a gray scale of a second sub-frame so as to display the input gray scale as a result of a summation of respective display corresponding to the first sub-frame and the second sub-frame into which one frame is divided, and the gray scale of the second sub-frame being greater than the gray scale of the first sub-frame, the method including the step of: setting a gray scale of the first sub-frame in the subsequent frame not more than a second threshold gray scale regardless of input gray scale of the subsequent frame, for a response in which (i) an input gray scale of a subsequent frame is greater than an input gray scale of a previous frame and (ii) the input gray scale of the subsequent frame is not less than a first threshold gray scale.

A display apparatus of the present invention includes a display panel and a display panel driving apparatus.

A television receiver of the present invention includes the display apparatus and a tuner section for receiving television broadcast.

As the above, with the display panel driving apparatus of the present invention, it is possible to remarkably reduce jaggy at an edge of a moving image. Therefore, it is possible to improve the quality of a moving image display on a display panel.

BRIEF DESCRIPTION OF DRAWINGS

FIG. 2 is a table showing one example of an OS LUT in accordance with the present embodiment.

FIG. 3 is a table showing a first sub-frame data LUT and a second sub-frame data LUT, in accordance with the present embodiment.

REFERENCE NUMERALS

Figure 1:
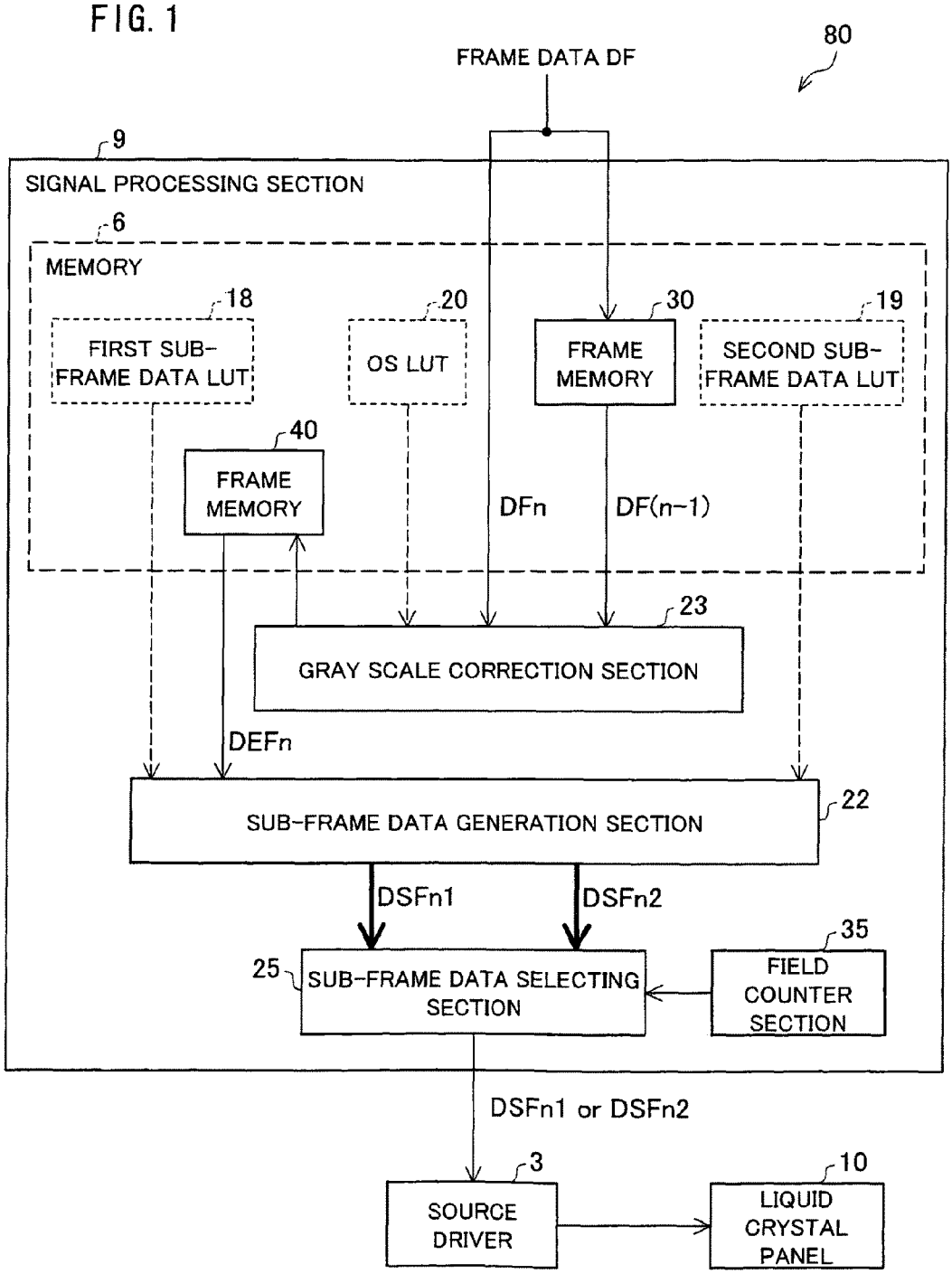
FIG. 1 is a block diagram illustrating an arrangement of a liquid crystal display apparatus in accordance with the present embodiment.

3 Source driver
6 Memory
9 Signal processing section
10 Liquid crystal panel
18 First sub-frame data LUT
19 Second sub-frame data LUT
20 OS LUT
22 Sub-frame data generation section (liquid crystal panel driving apparatus)
23 Gray scale correction section (liquid crystal panel driving apparatus)
25 Sub-frame data selecting section
30 Frame memory
40 Frame memory
80 Liquid crystal display apparatus
90 Television receiver
DF Frame data
DF (n−1) Previous frame data
DFn Subsequent frame data (current frame data)
DEFn Sub-frame calculation data
DSFn1 First sub-frame data
DSFn2 Second sub-frame data

BEST MODE FOR CARRYING OUT THE INVENTION

One embodiment of the present invention is described below with reference to FIGS. 1 through 6, and FIG. 10. FIG. 1 is a block diagram illustrating an arrangement of a liquid crystal display apparatus of the present embodiment. As illustrated in FIG. 1, a liquid crystal display apparatus 80 of the present embodiment includes a liquid crystal panel 10 and a liquid crystal panel driving apparatus (not illustrated). The liquid crystal panel driving apparatus includes a signal processing section 9 and a source driver 3. Note that the liquid crystal panel 10 and the source driver 3 may be integral with each other. The signal processing section 9 includes a memory 6, a sub-frame data generation section 22, a sub-frame data selecting section 25, and a field counter section 35. The memory (memory section) 6 includes an OS (overshoot) LUT 20 (first table), a first sub-frame data LUT 18 (second table), a second sub-frame data LUT 19 (third table), a frame memory 30, and a frame memory 40.

The liquid crystal panel 10 is preferably of a normally black type, and may include an n-type vertical alignment liquid crystal. A gamma of the liquid crystal panel 10 is set to 2.2.

The signal processing section 9 receives a frame data (input gray scale) DF at 60 [Hz]. The frame memory 30 stores frame data DF (n−1) of a previous frame by an amount corresponding to one frame.

The gray scale correction section 23 generates a sub-frame calculation data DEFn by using (i) the frame data DF (n−1) of the previous frame read out from the frame memory 30 and (ii) frame data DFn of a subsequent frame, with reference to the OS LUT 20. Thereafter, the sub-frame calculation data DEFn thus generated is stored in the frame memory 40.

The sub-frame data generation section 22 reads out the sub-frame calculation data DEFn from the frame memory 40 at a double-speed (120 Hz). Thereafter, the sub-frame data generation section 22 generates (i) a first sub-frame data DSFn1 with reference to the first sub-frame data LUT 18 and (ii) a second sub-frame data DSFn2 with reference to the second sub-frame data LUT 19.

The first sub-frame data DSFn1 and the second sub-frame data DSFn2 are inputted to the sub-frame data selecting section 25. The sub-frame data selecting section 25 alternately outputs the data DSFn1 and DSFn2 at a speed of 120 Hz. The field counter section 35, for example, watches output of the frame memory 40 so as to determine whether it is a timing of the first sub-frame display or the second sub-frame display, and supplies a determination result to the sub-frame data selecting section 25.

Based on the determination result of the field counter section 35, the sub-frame data selecting section 25 outputs the first sub-frame data DSFn1 to the source driver 3 at a start timing of the first sub-frame, and outputs the second sub-frame data DSFn2 to the source driver 3 at a start timing of the second sub-frame.

The source driver 3 converts each of the sub-frame data (DSFn1 and DSFn2) to an analog electric potential signal, and drives source lines (data signal lines) of the liquid crystal panel 10 in accordance with the potential signals.

The following description deals with a specific example in which the sub-frame calculation data (DEFn) is generated by the gray scale correction section 23. The gray scale correction section 23 carries out a transition gray scale enhancement (overshoot) process with respect to the frame data DFn of the subsequent frame by using the frame data DF (n−1) of the previous frame and the frame data DFn of the subsequent frame. This causes the sub-frame calculation data DEFn to be outputted from the gray scale correction section 23.

FIG. 2 is an example of the OS LUT 20. As shown in FIG. 2, the OS LUT 20 provides a sub-frame calculation data DEFn (sub-frame calculation gray scale) for a combination of a frame data DF (n−1) (input gray scale of a previous frame) and a frame data DFn (input gray scale of the subsequent frame). As to a combination other than the ones shown in FIG. 2, a sub-frame calculation data can be found with the use of a linear interpolation, for example.

In the OS LUT 20, a sub-frame calculation gray scale is set to 152 gray scale (a single predetermined gray scale) with respect to all of combinations in which (i) an input gray scale of a subsequent frame is greater than that of a previous frame and (ii) the input gray scale of the subsequent frame is not less than 160 gray scale (first threshold gray scale). A sub-frame calculation gray scale is set to an input gray scale of a subsequent frame with respect to all of combinations in which an input gray scale of a previous frame is equal to that of the subsequent frame.

For example, when an input gray scale of a previous frame is 0 gray scale and an input gray scale of the subsequent frame is 64 gray scale, 78 gray scale is generated as their sub-frame calculation gray scale. When an input gray scale of a previous frame is 0 gray scale and an input gray scale of the subsequent frame is 192 gray scale, 152 gray scale is generated as their sub-frame calculation gray scale. Even when an input gray scale of a previous frame is 32 gray scale and an input gray scale of the subsequent frame is 224 gray scale, 152 gray scale is generated as their sub-frame calculation gray scale. When an input gray scale of a previous frame is 192 gray scale and an input gray scale of the subsequent frame is 192 gray scale, 192 gray scale is generated as their sub-frame calculation gray scale.

The following description deals with a specific example in which the first and second sub-frame data (DSFn1 and DSFn2) are generated by the sub-frame data generation section 22. FIG. 3 shows an example of the first sub-frame data LUT 18 and an example of the second sub-frame data LUT 19, together in one table. Namely, the first sub-frame data DSFn1 (gray scale of the first sub-frame in the subsequent frame) corresponding to the sub-frame calculation data DEFn (sub-frame calculation gray scale) is stored in the first sub-frame data LUT, and the second sub-frame data DSFn2 (gray scale of the second sub-frame in the subsequent frame) corresponding to the sub-frame calculation data DEFn (sub-frame calculation gray scale) is stored in the second sub-frame data LUT.

In the first sub-frame data LUT 18 and the second sub-frame data LUT 19, the second sub-frame is set to always have a gray scale greater than the first sub-frame. When the sub-frame calculation gray scale is in a range of around 0 to 145 gray scale, the gray scale of the first sub-frame hardly increases (increase from 0 to 14 gray scale or so), however the gray scale of the second sub-frame drastically increases (increase from 0 to 236 gray scale or so). When the sub-frame calculation gray scale is in a range of around 145 to 255 gray scale, the gray scale of the second sub-frame hardly increases (increase from 236 to 255 or so), however the gray scale of the first sub-frame drastically increases (increase from 14 to 240 or so).

For example, when the sub-frame calculation gray scale is 64 gray scale, 4 gray scale is generated as the gray scale of the first sub-frame, and 159 gray scale is generated as the gray scale of the second sub-frame. When the sub-frame calculation gray scale is 128 gray scale, 10 gray scale is generated as the gray scale of the first sub-frame, and 235 gray scale is generated as the gray scale of the second sub-frame. When the sub-frame calculation gray scale is 152 gray scale, 16 gray scale is generated as the gray scale of the first sub-frame, and 239 gray scale is generated as the gray scale of the second sub-frame. When the sub-frame calculation gray scale is 174 gray scale, 32 gray scale is generated as the gray scale of the first sub-frame, and 246 gray scale is generated as the gray scale of the second sub-frame. When the sub-frame calculation gray scale is 192 gray scale, 56 gray scale is generated as the gray scale of the first sub-frame, and 249 gray scale is generated as the gray scale of the second sub-frame.

When the sub-frame calculation gray scale is in a range of 0 to 152 gray scale, the gray scale of the first sub-frame is not more than 16 gray scale (second threshold gray scale). Thus, it is hardly possible to independently visualize the first sub-frame. When the sub-frame calculation gray scale is in a range of 153 to 175 gray scale, the gray scale of the first sub-frame is not more than 32 gray scale. Thus, it is difficult to independently visualize the first sub-frame. However, when the sub-frame calculation gray scale is not less than 176 gray scale, the gray scale of the first sub-frame is greater than 32 gray scale, thereby allowing the first sub-frame to be independently visualized.

As such, when it is assumed that a gray scale TH and a gray scale TL satisfy (i) 160 gray scale (the first threshold gray scale)<the gray scale TH, and (ii) the gray scale TL<the gray scale TH in the sub-frame data generation section 22, (i) in case of a response in which an input gray scale of a previous frame and an input gray scale of the subsequent frame are both the gray scale TH, a gray scale TH1 is outputted as a gray scale of the first sub-frame in the subsequent frame, and (ii) in case of a response in which an input gray scale of a previous frame is TL and an input gray scale of the subsequent frame is TH, a gray scale Th1 is outputted as a gray scale of the first sub-frame in the subsequent frame. As such, the gray scales TH1 and Th1 satisfy Th1≦16 gray scale (the second threshold gray scale), and TH1≧Th1. Note that the second threshold gray scale may be raised up to 32 grayscale. In this case, the first threshold gray scale is 174 gray scale. On this account, it is possible that a difference between (i) brightness corresponding to the gray scale of the first sub-frame in the subsequent frame and (ii) brightness corresponding to the gray scale of the first sub-frame of the previous frame is not more than 15 percent (preferably 5 percent) of brightness corresponding to the gray scale of the first sub-frame in the previous frame, in a rising response in which an input gray scale of the subsequent frame is not less than the first threshold gray scale. This allows the first sub-frame in the subsequent frame not to be independently visualized (to be difficult to visualize) in the rising response.

According to the signal processing section (e.g. gray scale correction section 23 and sub-frame data generations section 22) of the present embodiment, it is possible to improve the quality of moving image display as follows.

Figure 4:
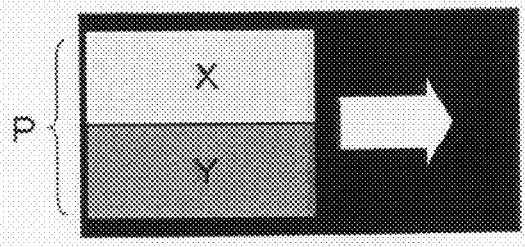
FIG. 4 is an explanatory view schematically illustrating one example of a moving image display.

FIG. 4 illustrates one example of a moving image display made by the liquid crystal display apparatus of the present embodiment. FIG. 4 illustrates an image P moving to the right in the drawing in a black background. In the image P, an area X which has an input gray scale of 192 gray scale and an area Y which has an input gray scale of 64 gray scale are adjacent to each other, i.e., a high gray scale area X and a low gray scale area Y are adjacent to each other so that their respective adjacent edges form a line. In this moving image display, a right edge (an edge in a moving direction) of the area X is of a rising response from 0 to 192 gray scale, and a right edge (an edge in the moving direction) of the area Y is of a rising response from 0 to 64 gray scale.

Therefore, according to the present embodiment (the gray scale correction section 23 and the sub-frame data generation section 22 shown in FIG. 1), the gray scales of the first and second sub-frames of the right edges of the areas X and Y are set as follows. Specifically, in the right edge of the area X, 152 gray scale is outputted as the sub-frame calculation gray scale from the gray scale correction section 23 (see FIG. 2). Therefore, gray scales of the first and second sub-frames are set to be 16 gray scale and 239 gray scale (see FIG. 3), respectively. In the right edge of the area Y, 78 gray scale is outputted as the sub-frame calculation gray scale from the gray scale correction section 23. Therefore, gray scales of the first and second sub-frames are set to be 4 gray scale and 178 gray scale (see FIG. 3), respectively.

Figure 5:
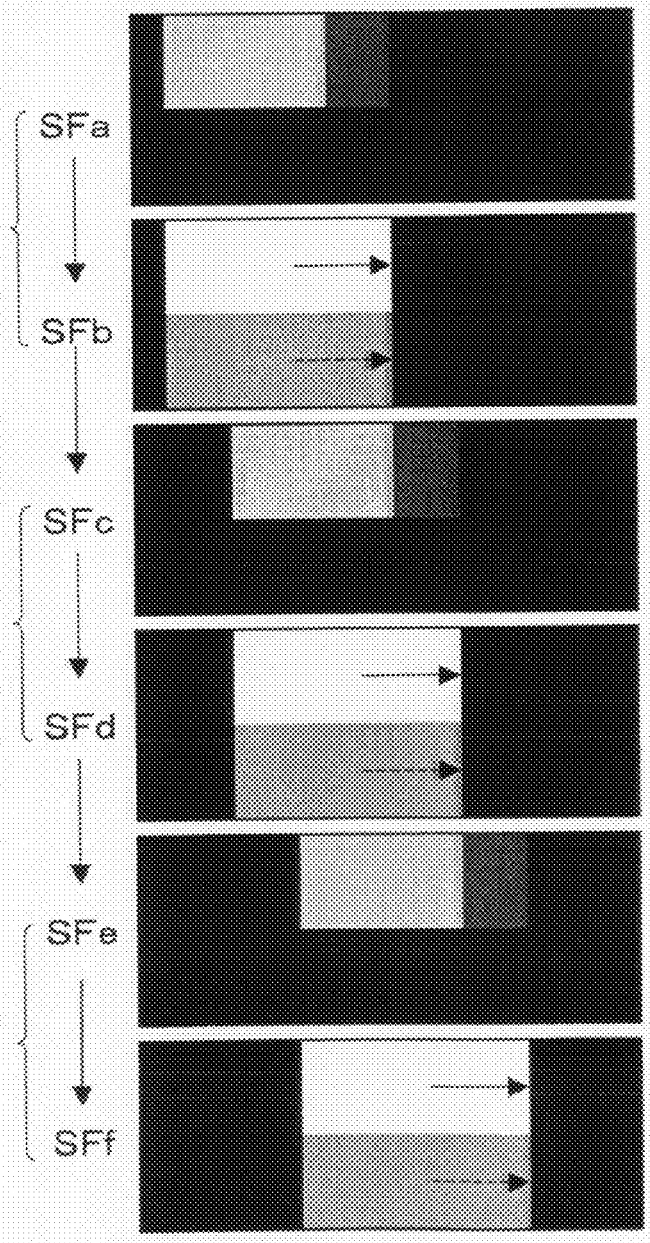
FIG. 5 is an explanatory view schematically illustrating a sub-frame display of the present embodiment, in the moving image display shown in FIG. 4.

SFa through SFf shown in FIG. 5 schematically illustrate respective sub-frame display in the above moving image display (corresponding to three frames). Namely, at the right edge of the area X, a gray scale of the first sub-frame is a hardly visible 16 gray scale, and at the right edge of the area Y, a gray scale of the first sub-frame is an invisible 4 gray scale.

Figure 6:
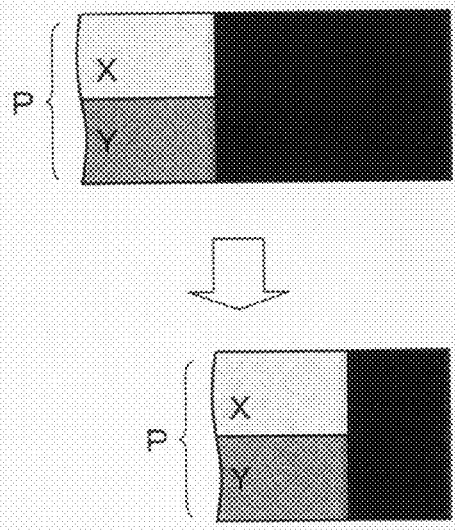
FIG. 6 is an explanatory view schematically illustrating a moving image display (of the present embodiment) attainable by the sub-frame display shown in FIG. 5.
Figure 7:
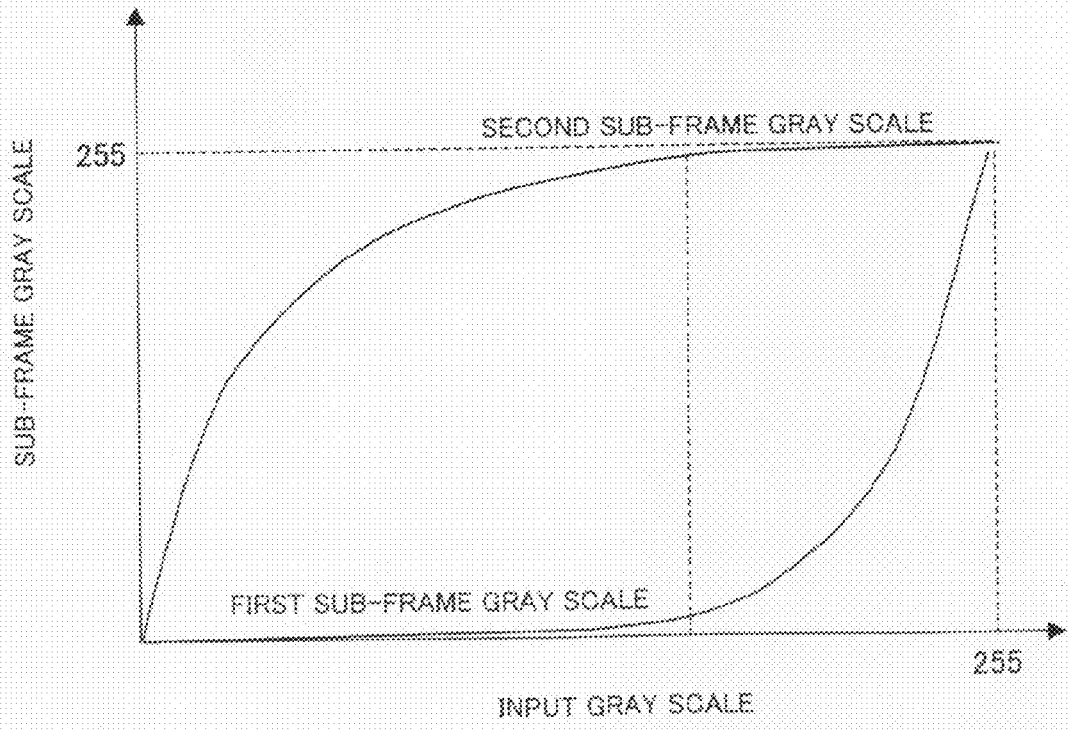
FIG. 7 shows a graph used when setting each sub-frame gray scale in a time-division driving.
Figure 8:
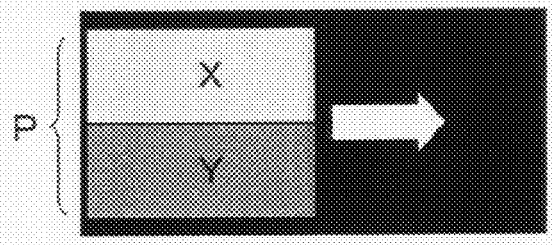
FIG. 8 is an explanatory view schematically illustrating one example of a moving image display.
Figure 9:
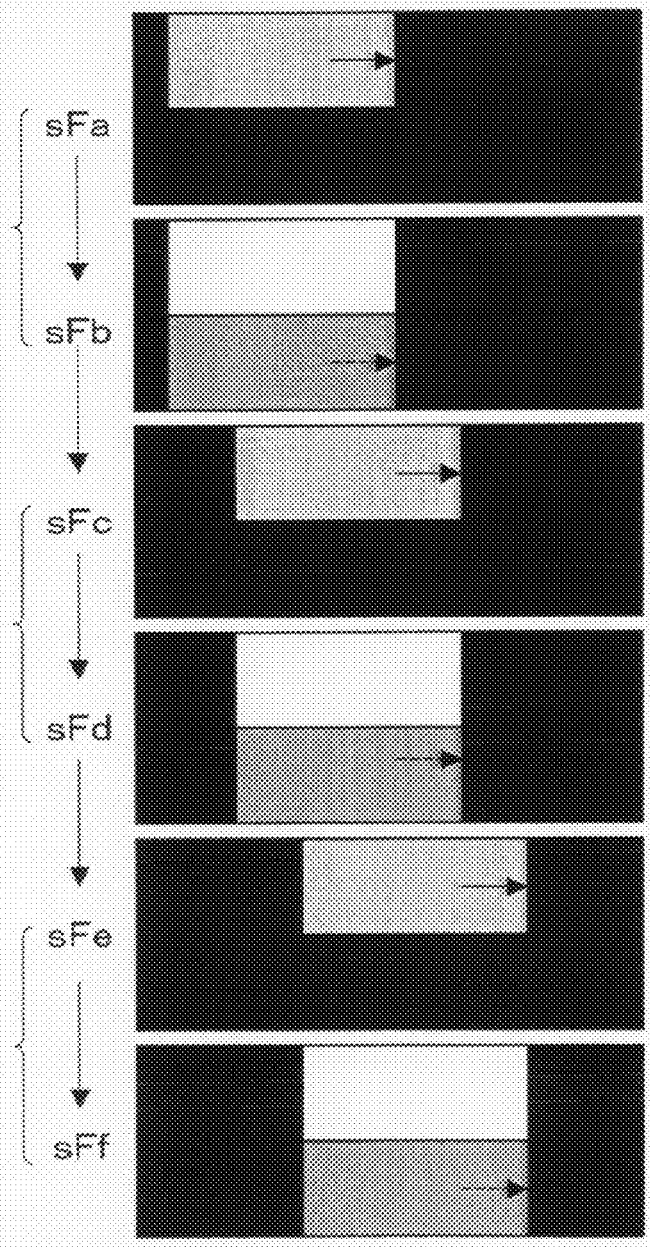
FIG. 9 is an explanatory view schematically illustrating a conventional sub-frame display (in the moving image display shown in FIG. 8).
Figure 12:
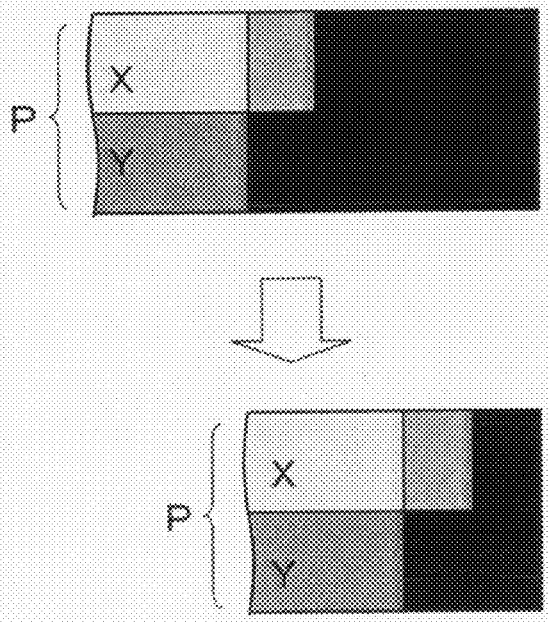
FIG. 12 is an explanatory view schematically illustrating a conventional moving image display attained by the sub-frame display shown in FIG. 9.

Accordingly, as illustrated in FIG. 5, the right edge of the area X in each frame starts to be visualized from the second sub-frame (SFb, SFd, SFf) (see solid arrow), and the right edge of the area Y in each frame also starts to be visualized from the second sub-frame (sFb, sFd, sFf) (see dotted line arrow). Therefore, the right edge of the areas X and Y start to be visualized at the same timing for each frame. By thus matching the visualization start timing of the right edges in the areas X and Y for each frame, it is possible to match the temporal integration values of brightness at the edges of the areas. Thus, the right edge of the image P is appropriately visualized as shown in FIG. 6. That is to say, with the present embodiment, it is possible to remarkably reduce conventionally visualized jaggy (see FIG. 12) at an edge of a moving image.

Figure 10:
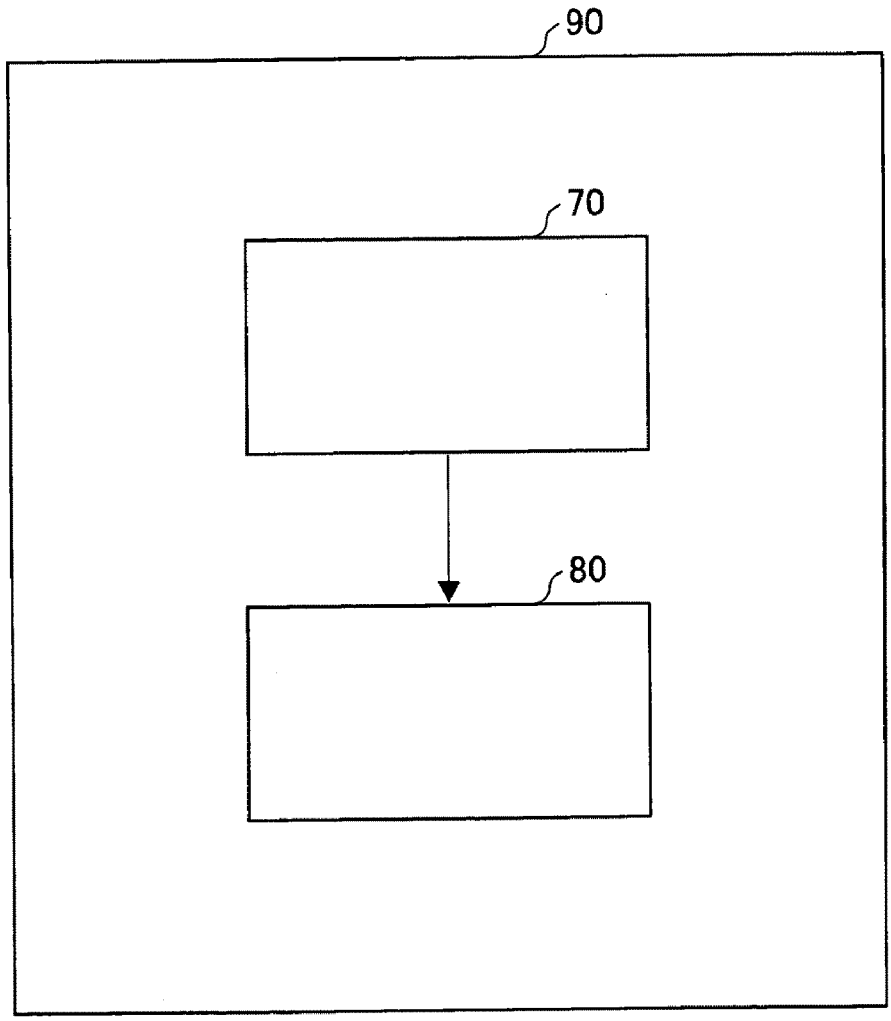
FIG. 10 is a block diagram illustrating an arrangement of a television receiver in accordance with the present embodiment.
Figure 11:
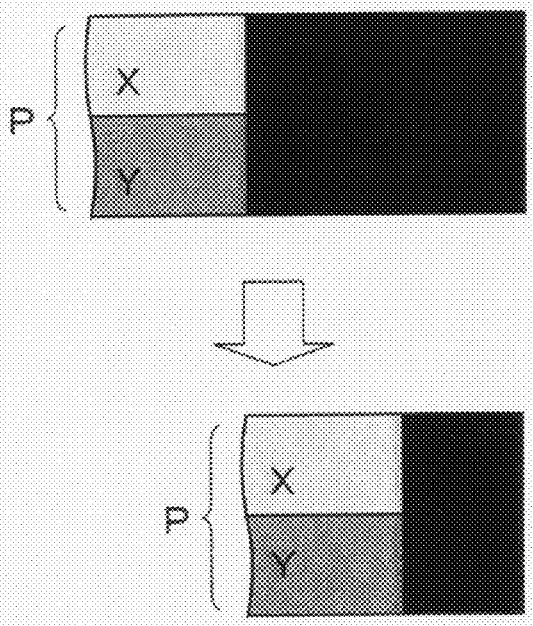
FIG. 11 is an explanatory view schematically illustrating an appropriate example of the moving image display shown in FIG. 8.

A television receiver (liquid crystal television) of the present embodiment includes a liquid crystal display apparatus 80 of the present embodiment and a tuner section 70, as illustrated in FIG. 10. The tuner section 70 receives television broadcast, and outputs video signals. Namely, in the television receiver 90, the liquid crystal display apparatus 80 performs video (image) display based on the video signals outputted from the tuner section 70.

Although functions of the sections in the signal processing section 9 shown in FIG. 1 are realizable by hardware logic, it is also possible to realize the functions by software. In the present embodiment, the functions are realized by ASIC.

INDUSTRIAL APPLICABILITY

A liquid crystal panel driving apparatus of the present invention and a liquid crystal display apparatus including the liquid crystal panel driving apparatus are suitable for a liquid crystal television, for example.

The invention claimed is:

1. A display panel driving apparatus configured to generates, based on an input gray scale, a gray scale of a first sub-frame and a gray scale of a second sub-frame so as to display the input gray scale as a result of a summation of respective display corresponding to the first sub-frame and the second sub-frame into which one frame is divided, and the gray scale of the second sub-frame being not less than the gray scale of the first sub-frame, for a response in which (i) an input gray scale of a subsequent frame is greater than an input gray scale of a previous frame and (ii) the input gray scale of the subsequent frame is not less than a first threshold gray scale, a gray scale of the first sub-frame in the subsequent frame being set to be not more than a second threshold gray scale, regardless of input gray scale of the subsequent frame, wherein the first threshold gray scale is greater than the second threshold gray scale; and if a first input gray scale is less than the second threshold gray scale and the first threshold gray scale is less than a second input gray scale, (a) for a response in which the input gray scale of the previous frame is the second input gray scale and the input gray scale of the subsequent frame is the second input gray scale too, the gray scale of the first sub-frame in the subsequent frame is set to be greater than the second threshold gray scale (b) for a response in which the input gray scale of the previous frame is the first input gray scale and the input gray scale of the subsequent frame is the second input gray scale, the gray scale of the first sub-frame in the subsequent frame is set to be not more than the second threshold gray scale.

2. The display panel driving apparatus as set forth in claim 1, wherein the first threshold gray scale is greater than a medium gray scale of all of input gray scales.

3. The display panel driving apparatus as set forth in claim 1, wherein the second threshold gray scale is not more than 32 gray scale out of 256 gray scales.

4. The display panel driving apparatus as set forth in claim 1, wherein the second threshold gray scale is 16 gray scale out of the 256 gray scales.

5. The display panel driving apparatus as set forth in claim 1, wherein, in said response, a difference between brightness corresponding to the gray scale of the first sub-frame in the subsequent frame and brightness corresponding to the gray scale of the first sub-frame in the previous frame is not more than 15 percent of brightness corresponding to the gray scale of the first sub-frame in the previous frame.

6. The display panel driving apparatus as set forth in claim 1, wherein, in said response, a difference between brightness corresponding to the gray scale of the first sub-frame in the subsequent frame and brightness corresponding to the gray scale of the first sub-frame in the previous frame is not more than 5 percent of the brightness corresponding to the gray scale of the first sub-frame in the previous frame.

7. The display panel driving apparatus as set forth in claim 1, wherein a sub-frame calculation gray scale is generated by using the input gray scale of the previous frame and the input gray scale of the subsequent frame, and the gray scales of the first and second sub-frames of the subsequent frame are generated by using the sub-frame calculation gray scale.

8. The display panel driving apparatus as set forth in claim 7, wherein the sub-frame calculation gray scale is attained by carrying out a gray scale transition enhancement process with respect to the input gray scale of the subsequent frame.

9. The display panel driving apparatus as set forth in claim 7, wherein, when a difference between the input gray scales of the previous and subsequent frames is 0 or is less than a predetermined value, the input gray scale of the subsequent frame is generated as the sub-frame calculation gray scale.

10. The display panel driving apparatus as set forth in claim 9, further comprising:

a first table which corresponds a combination of the input gray scales of the previous and subsequent frames to the sub-frame calculation gray scale, the sub-frame calculation gray scale being generated based on the first table.

11. The display panel driving apparatus as set forth in claim 10, further comprising:

a second table which corresponds the sub-frame calculation gray scale to the first sub-frame in the subsequent frame, the gray scale of the first sub-frame in the subsequent frame being generated based on the second table.

12. The display panel driving apparatus as set forth in claim 10, further comprising:

a third table which corresponds the sub-frame calculation gray scale to the second sub-frame in the subsequent frame, the gray scale of the second sub-frame in the subsequent frame being generated based on the third table.

13. The display panel driving apparatus as set forth in claim 11, wherein:

in the first table, a single predetermined gray scale is set for all combinations in which (i) the input gray scale of the subsequent frame is greater than the input gray scale of the previous frame and (ii) the input gray scale of the subsequent frame is not less than the first threshold gray scale; and the predetermined gray scale is generated as the sub-frame calculation gray scale for all combinations in which input gray scales of the previous and subsequent frames fall within the combinations.

14. The display panel driving apparatus as set forth in claim 13, wherein:

in the second table, the predetermined gray scale is corresponded to the second threshold gray scale; and when the sub-frame calculation gray scale is the predetermined gray scale, the second threshold gray scale is generated as the first sub-frame in the subsequent frame.

15. The display panel driving apparatus as set forth in claim 1, wherein the display panel driving apparatus drives a liquid crystal panel.

16. The display panel driving apparatus as set forth in claim 15, wherein the liquid crystal panel is of a normally black type.

17. The display panel driving apparatus as set forth in claim 16, wherein the liquid crystal panel comprises an n-type vertical alignment liquid crystal.

18. A display panel driving apparatus configured to generates, based on an input gray scale, gray scales of first through n-th sub-frames so as to display the input gray scale as a result of a summation of respective display corresponding to the first through n-th sub-frames into which one frame is divided, the first through n-th sub-frames being divided into a first half section including at least the first sub-frame and a last half section including at least the n-th sub-frame, and each sub-frame of the last half section having gray scale greater than that of each sub-frame of the first half section, for a response in which (i) an input gray scale of a subsequent frame is greater than an input gray scale of a previous frame and (ii) the input gray scale of the subsequent frame is not less than a first threshold gray scale, a gray scale of said each sub-frame of the first half section in the subsequent frame being set to be not more than a second threshold gray scale, regardless of input gray scale of the subsequent frame, wherein the first threshold gray scale is greater than the second threshold gray scale; and if a first input gray scale is less than the second threshold gray scale and the first threshold gray scale is less than a second input gray scale, (a) for a response in which the input gray scale of the previous frame is the second input gray scale and the input gray scale of the subsequent frame is the second input gray scale too, the gray scale of said each sub-frame of the first half section in the subsequent frame is set to be greater than the second threshold gray scale (b) for a response in which the input gray scale of the previous frame is the first input gray scale and the input gray scale of the subsequent frame is the second input gray scale, the gray scale of said each sub-frame of the first half section in the subsequent frame is set to be not more than the second threshold gray scale.

19. A method for driving a display panel, which method generates, based on an input gray scale, a gray scale of a first sub-frame and a gray scale of a second sub-frame so as to display the input gray scale as a result of a summation of respective display corresponding to the first sub-frame and the second sub-frame into which one frame is divided, and the gray scale of the second sub-frame being greater than the gray scale of the first sub-frame, said method comprising the step of:

setting a gray scale of the first sub-frame in the subsequent frame not more than a second threshold gray scale regardless of input gray scale of the subsequent frame, for a response in which (i) an input gray scale of a subsequent frame is greater than an input gray scale of a previous frame and (ii) the input gray scale of the subsequent frame is not less than a first threshold gray scale, wherein:

the first threshold gray scale is greater than the second threshold gray scale; and if a first input gray scale is less than the second threshold gray scale and the first threshold gray scale is less than a second input gray scale, (a) for a response in which the input gray scale of the previous frame is the second input gray scale and the input gray scale of the subsequent frame is the second input gray scale too, setting the gray scale of the first sub-frame in the subsequent frame to be greater than the second threshold gray scale (b) for a response in which the input gray scale of the previous frame is the first input gray scale and the input gray scale of the subsequent frame is the second input gray scale, setting the gray scale of the first sub-frame in the subsequent frame to be not more than the second threshold gray scale.

20. A display apparatus comprising:

a display panel; and a display panel driving apparatus as set forth in claim 1.

21. A television receiver comprising:

a display apparatus as set forth in claim 20; and a tuner section for receiving television broadcast.

22. A display apparatus comprising:

a display panel; and a display panel driving apparatus as set forth in claim 18.

* * * * *